United States Patent [19]

Edwards et al.

[11] Patent Number: 4,858,688

[45] Date of Patent: Aug. 22, 1989

[54] SUCKER ROD GUIDE

[76] Inventors: Billy J. Edwards, 1917 Cambridge, Bossier City, La. 71112; Jimmy A. Starks, 1105 James, Bossier City, La. 71111

[21] Appl. No.: 211,567

[22] Filed: Jun. 27, 1988

[51] Int. Cl.[4] ..... E21B 17/10

[52] U.S. Cl. ..... 166/241; 175/325

[58] Field of Search ..... 166/241, 242, 176; 175/325

[56] References Cited

U.S. PATENT DOCUMENTS

| | | | |
|---|---|---|---|
| 2,299,978 | 10/1942 | Hall | 175/325 |
| 2,793,917 | 5/1957 | Ward | 166/176 |
| 2,897,016 | 7/1959 | Baker | 175/325 |
| 3,320,004 | 5/1967 | Garrett | 175/325 |
| 3,442,558 | 5/1969 | Sable | 175/325 |
| 3,516,494 | 6/1970 | Ward | 166/176 |
| 3,889,579 | 6/1975 | Wiechowski et al. | 166/72 |
| 4,182,537 | 1/1980 | Oster | 166/176 |
| 4,575,163 | 3/1986 | Sable | 166/241 |

*Primary Examiner*—Jerome W. Massie
*Assistant Examiner*—Terry Lee Melius
*Attorney, Agent, or Firm*—John M. Harrison

[57] ABSTRACT

A sucker rod guide for mounting on a sucker rod in multiple, spaced units and preventing, or at least minimizing, contact between the sucker rod and the tubing which encloses the sucker rod. In a preferred embodiment, the sucker rod guide is characterized by an extruded plastic material having an ultra-high density and a coefficient of friction when wet which is lower than that of metal, to increase the overall pumping efficiency of oil wells. In a most preferred embodiment of the invention, the sucker rod guide is constructed of a self-lubricating, high-density, extruded polyethylene plastic. The sucker rod guide includes a longitudinal, grooved bore which is preferably undersized with respect to the sucker rod upon which the sucker rod guide is mounted and a tapered body slot which communicates with the bore for inserting the sucker rod guide on a sucker rod at a desired location. Multiple units of the sucker rod guide are attached to the sucker rod string in spaced relationship, in order to space the sucker rod string from the tubing, lubricate the reciprocating or spinning action of the sucker rod string and prevent or minimize sucker rod and tubing wear.

4 Claims, 1 Drawing Sheet

SUCKER ROD GUIDE

BACKGROUND OF THE INVENTION

Field of the Invention

This invention relates to production equipment for oil wells and more particularly, to sucker rod guides for mounting in spaced relationship on the sucker rod string of a pumping well. The sucker rod guides of this invention are each characterized by a generally cylindrically-shaped, smooth guide body having tapered top and bottom portions and a longitudinal, grooved bore which is preferably slightly undersized with respect to the sucker rod to which the sucker rod guides are attached. A tapered, inwardly expanding, longitudinal body slot extends through the entire guide body of the sucker rod guide and communicates with the longitudinal bore, in order to provide a means for mounting one or more sucker rod guides on a sucker rod at a specific location. In a preferred embodiment, the sucker rod guide of this invention is constructed by extruding a molten, high density, self-lubricating polyethylene plastic through a die to define a slotted cylinder having a smooth bore and a tapered longitudinal slot. Grooves may then be added to the bore by using a reaming tool, to facilitate a more firm attachment to the sucker rod. Alternatively, the extruded, slotted cylinder can be centrally drilled to provide the longitudinal bore and the spaced grooves.

It has surprisingly been found that extruded molten polyethylene creates an ultra-high density, round bar stock which produces a sucker rod guide that yields an abrasion factor which is far superior to that of conventional sucker rod guides. In fact, it has been found by analysis and testing that extruded high density polyethylene plastic contains approximately two million molecules per square inch of extruded bar stock material, a density factor which accounts for the superior abrasion and self-lubricating characteristics of the extruded plastic material. It has also been found that the polyethylene sucker rod guides of this invention are not adversely affected by corrosive hydrogen sulfide, salt water and other fluids and compounds normally found in an oil well.

Sucker rod guides of various description and composition are designed to fit on sucker rods used to pump oil wells, in order to eliminate, or at least greatly reduce, many of the down-hole problems which are characteristic of production equipment in oil wells. These guides are generally characterized by a coefficient of friction when wet which is lower than that of metal and they operate to increase the overall pumping efficiency of the wells, while at the same time prevent undesirable metal-to-metal contact between the reciprocating or spinning rods and the stationary tubing. Wear on sucker rod couplings used to make up the down-hole sucker rod string is also minimized, thus reducing the required inventory of costly rod parts. Tubing wear, often unseen until failure occurs, is also reduced, because the sucker rod guides receive the wear rather than the expensive tubing. The sucker rod guides also function as bearings to centralize the sucker rods in the tubing and even when the tubing buckles in a well during upstroke of the pumping unit, the sucker rods cannot contact the tubing due to the spaced positioning of the sucker rod guides. Polish rod loads are also reduced because of the lower friction and less abrupt "stress reverse" which is realized when using sucker rod guides. Accordingly, a properly designed sucker rod installation can result in significant savings in both equipment replacement and service costs in a pumping oil well. Fewer "pulling jobs", greater pumping efficiency and wells that stay in the pumping mode for longer periods of time, are proven results obtained from the use of sucker rod guides.

Sucker rod guides of various design, size and materials of construction are well known in the art. Typical materials of construction are neoprene rubber and nylon and these materials are commonly used with metal inserts which encase and line the sucker rod bore, in order to better grip the sucker rod and maintain the sucker rod guide in a selected position on the sucker rod. However, it has been found that friction between neoprene rubber sucker rod guides and the tubing as the sucker rod guide reciprocates with the sucker rod string inside the tubing, sometimes generates heat which may result in a fairly rapid deterioration of the neoprene material, thereby necessitating frequent "pulling jobs" in order to replace the guides. Furthermore, it has been found that nylon sucker rod guides are brittle and are sometimes difficult to mount on a sucker rod without breaking, especially in cold weather. Sucker rod guides are typically secured to the respective lengths of sucker rod in spaced relationship, in order to space the sucker rod string from the tubing and protect both the sucker rod, sucker rod couplings and the tubing from excessive wear during the pumping operation. Since the reciprocating travel of each sucker rod and sucker rod guide may be from approximately 3 feet to about 20 feet or more and this travel occurs at a rate of about 15 strokes per minute on the average, the sucker rod guide material should be self-lubricating or easily lubricated by the well fluid and must have good wear characteristics, in order to minimize the frequency of maintenance.

Accordingly, it is an object of this invention to provide a new and improved plastic sucker rod guide for mounting on the sucker rod of an oil well and preventing, or at least minimizing, metal-to-metal contact between the sucker rod and the tubing.

Another object of this invention is to provide a new and improved molded polyethylene sucker rod guide which is characterized by an exceptionally high molecular density and good self-lubricating characteristics and is designed to tightly seat on the sucker rod of a pumping well at a specific location, with minimum displacement from the point of installation, to space the sucker rod from the tubing.

Still another object of this invention is to provide a sucker rod guide for mounting on the sucker rod of a pumping unit in an oil well, which sucker rod guide includes a generally cylindrically-shaped, extruded polyethylene body having a longitudinal, smooth or grooved sucker rod bore which is slightly undersized with respect to the sucker rod to which it is attached and further including an inwardly expanding, tapered body slot extending longitudinally through the sucker rod guide body and communicating with the sucker rod bore, to facilitate mounting the sucker rod guide on the sucker rod.

A still further object of this invention is to provide a generally cylindrically-shaped, extruded, high density polyethylene sucker rod guide provided with a longitudinal, circumferentially grooved sucker rod bore which is slightly undersized with respect to the sucker rod to which the guide is attached and having a longitudinal, tapered slot extending through the sucker rod guide body and communicating with the sucker rod bore, for mounting the sucker rod guide on the sucker rod.

SUMMARY OF THE INVENTION

These and other objects of the invention are provided in a new and improved sucker rod guide for mounting on a sucker rod in an oil well pumping unit, which sucker rod guide is characterized by an extruded, substantially self-lubricating, high density polyethylene guide body having a top and bottom taper and a circumferentially grooved sucker rod bore extending longitudinally there-through, which bore is slightly undersized with respect to the sucker rod to which it is attached and further including an inwardly-expanding, tapered slot widening transversely and extending longitudinally through the sucker rod guide body and communicating with the sucker rod bore, for mounting the sucker rod guide on the sucker rod and insuring that the sucker rod guide is maintained approximately at the point of installation on the sucker rod during operation of the pumping unit. In a preferred embodiment, the degree of undersize of the sucker rod bore and the degree of taper provided in the tapered slot are chosen such that the slot walls are approximately parallel to each other when the sucker rod guide is mounted on a sucker rod.

BRIEF DESCRIPTION OF THE DRAWING

The invention will be better understood by reference to the accompanying drawing, wherein.

DESCRIPTION OF THE PREFERRED EMBODIMENTS

Figure 1:
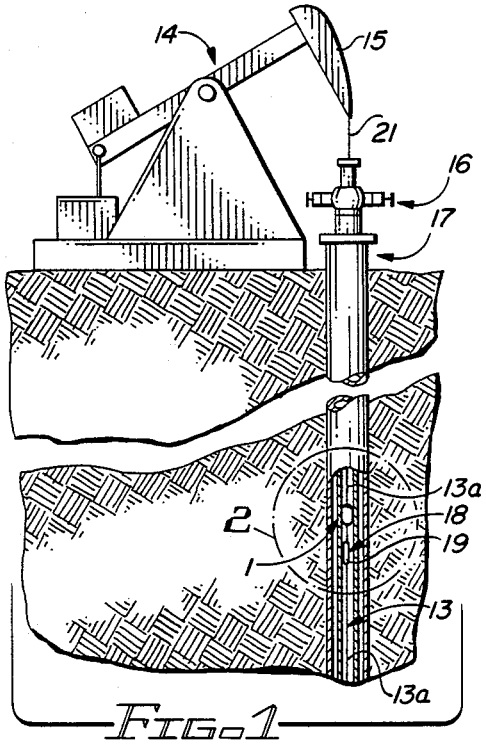
FIG. 1 is a side elevation, partially in section, of a typical pumping unit and related production equipment for an oil well.
Figure 3:
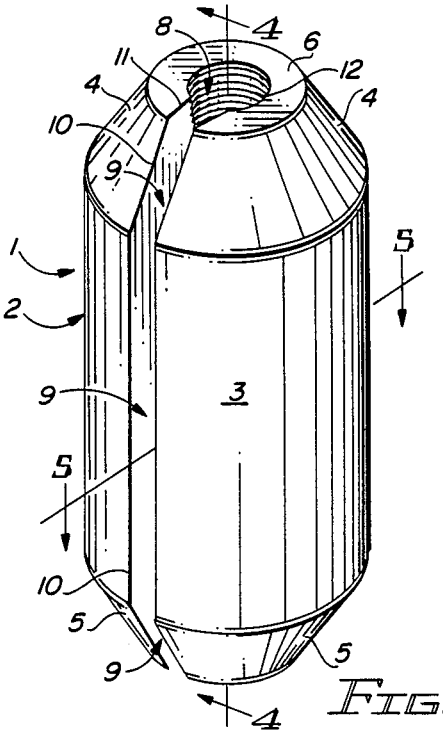
FIG. 3 is a perspective view of a preferred embodiment of an unmounted sucker rod guide of this invention.
Figure 2:
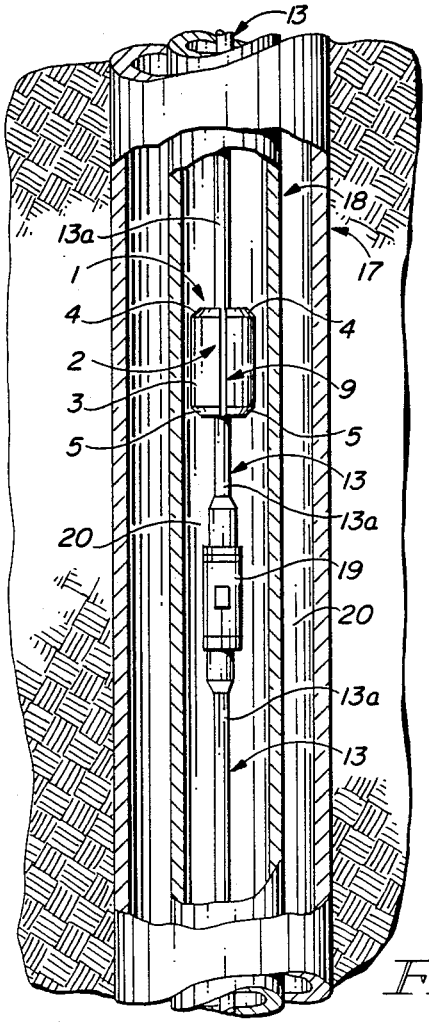
FIG. 2 is an enlarged sectional view of a length of casing and tubing illustrated in FIG. 1, with a sucker rod reciprocating inside the tubing and a sucker rod guide mounted on the sucker rod.

Referring initially to FIGS. 1–3 of the drawing, a conventional pumping unit is generally illustrated by reference numeral 14 and is fitted with a horsehead 15, for reciprocating a polish rod 21 in a well head 16 and a connecting sucker rod string 13 inside a length of tubing 18 which is concentrically enclosed in a casing 17. The horsehead 15 is located above the well head 16 and the sucker rod string 13 extends downwardly from the polish rod 21 through the tubing 18 to a down-hole pump (not illustrated). The down-hole pump is designed to pump production fluid upwardly in the direction of the arrow through a production annulus 20, inside the tubing 18, as illustrated in FIG. 2. The sucker rod string 13 includes multiple lengths of sucker rods **13*a*, which are joined at the sucker rod couplings 19**, in order to locate the down-hole pump (not illustrated) at a selected producing interval location (not illustrated) in the well.

Multiple units of the sucker rod guide 1 are located in spaced relationship on each of the sucker rods **13*a*, preferably at points near the sucker rod couplings 19, in order to space the sucker rods 13*a* and the sucker rod couplings 19 from the inside wall of the tubing 18 during reciprocation of the sucker rod string 13 pursuant to operation of the pumping unit 14. As illustrated in FIG. 3, each sucker rod guide 1 is characterized by a shaped guide body 2, having a generally cylindrically-shaped, smooth center body section 3 and terminated at one end by a top taper 4 and a flat top margin 6 and at the opposite end by a bottom taper 5 and a corresponding flat bottom margin 7. A sucker rod bore 8 is provided longitudinally through the center of the guide body 2 and in a preferred embodiment of the invention, the sucker rod bore 8 is slightly undersized and most preferably, about 1/16 of an inch undersized, with respect to the sucker rod 13*a* to which the sucker rod guide 1 is attached. The sucker rod bore 8 may be smooth. However, in another preferred embodiment of the invention, multiple circumferential grooves 12 are provided in the sucker rod bore 8, in order to help maintain each sucker rod guide 1 tightly on a companion sucker rod 13*a* in a selected location, in spite of contact between the guide body 2 and the inside surface of the tubing 18 during reciprocation or spinning of the sucker rod string 13. An inwardly expanding, tapered body slot 9 is provided in the guide body 2 of the sucker rod guide 1 and extends longitudinally from the top margin 6 completely through the guide body 2 and through the bottom taper 5 and communicates with the sucker rod bore 8, as illustrated in FIG. 3**.

Figure 5:
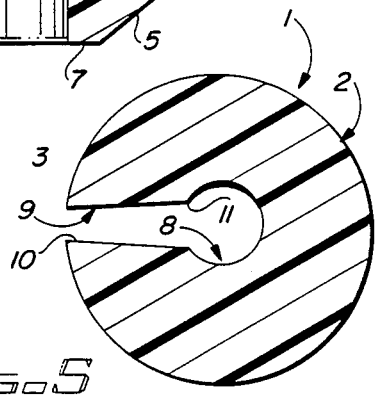
FIG. 5 is a sectional view taken along line 5—5 of the sucker rod guide illustrated in FIG. 3.

As illustrated in FIGS. 3 and 5, in a most preferred embodiment of the invention, when the sucker rod guide 1 is not installed on a sucker rod **13*a*, the body slot 9 is tapered from a slot mouth 10 to a slot throat 11, such that the body slot 9 is wider at the slot throat 11 than at the slot mouth 10. Accordingly, this feature, in combination with the undersizing of the sucker rod bore 8 with respect to the sucker rod 13*a* to which the sucker rod guide 1 is attached, serves to effect a spring-like action in the sucker rod guide 1 to more tightly mount each sucker rod guide 1 on a companion sucker rod 13*a*. When the sucker rod guide 1 is installed on a sucker rod 13*a*, the spaced sides of the body slot 9 are approximately parallel and the slot mouth 10 is substantially equal to or greater than the width of the slot throat 11. It has been found that this configuration of the body slot 9, in combination with the undersizing of the sucker rod bore 8, serves to maintain each sucker rod guide 1 substantially in the desired installed location on a companion sucker rod 13*a*, despite the reciprocating or spinning action of the sucker rod string 13 with accompanying frequent contact between the center body section 3 of the sucker rod guide 1 and the inside surface of the tubing 18**.

In another most preferred embodiment of the invention, the sucker rod guide 1 of this invention is characterized by an extruded, high density polyethylene material which has self-lubricating and/or wet-lubricating characteristics. For example, it has been found that in addition to excellent lubricating qualities, the round extruded polyethylene barstock used to fabricate the sucker rod guide 1 is characterized by a density of up to about two million molecules per square inch, which density results in an abrasion factor that is far superior to that of conventional sucker rod guides.

Figure 4:
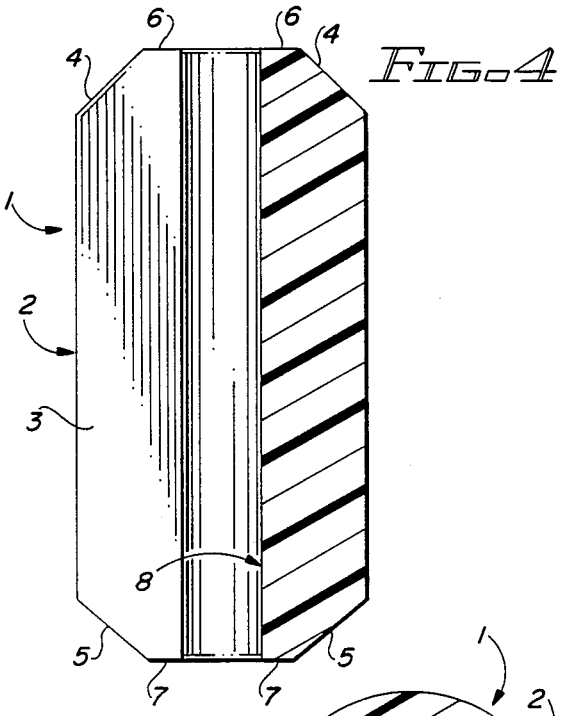
FIG. 4 is a sectional view taken along line 4—4 of the sucker rod guide illustrated in FIG. 3.

Referring again to FIGS. 3–5 of the drawing, it will be appreciated by those skilled in the art that the centrally-located sucker rod bore 8 provided in the guide body 2 of the sucker rod guide 1 can either be drilled therein using a special bit which inscribes the repetitive circumferential grooves 12, or the guide body 2 and the tapered body slot 9 can be extruded as round bar stock. The sucker rod bore 8 may also be extruded in the round bar stock, along with the tapered body slot 9 and a special tool can then be used to ream and inscribe the grooves 12, as desired. It will be further appreciated that the top taper 4 and the bottom taper 5 provided in the guide body 2 to define the center body section 3 are provided, in order to insure that minimal friction is created in the bore of the tubing 18 when the sucker rod guide reciprocates or spins therein responsive to reciprocating or spinning movement of the sucker rod string 13.

Referring again to FIGS. 3 and 5 of the drawing, in a most preferred embodiment of the invention the sucker rod guide 1 is mounted on a sucker rod 13*a* by placing the guide body 2 on the sucker rod 13*a* with the slot mouth 10 lying adjacent to the sucker rod 13*a*. The guide body 2 is then struck sharply with a hammer or mallet to momentarily spring the tapered body slot 9 open and force the guide body 2 onto the sucker rod 13*a*, such that the sucker rod 13*a* locates and seats in the undersized sucker rod bore 8. Accordingly, as heretofore described, the "spring" action created by the tapered body slot 9, coupled with the 1/16 inch undersize in the sucker rod bore 8, causes the guide body 2 to tightly grip the sucker rod 13*a* at the desired installed location to minimize movement of the sucker rod guide 1 on the sucker rod 13*a* responsive to reciprocation or spinning of the sucker rod string 13 and the sucker rod guide 1 inside the tubing 18. This "spring" action causes the slot mouth 10 of the body slot 9 to enlarge slightly when the sucker rod 13*a* is seated in the rod bore 8, such that the slot mouth 10 is substantially equal in width to that of the slot throat 11, as heretofore described.

It will be appreciated by those skilled in the art that the sucker rod guides 1 of this invention can be constructed to fit on sucker rods 13*a* of any diameter and specification, in non-exclusive particular, as follows: for a one inch O.D. sucker rod 13*a*, the slot mouth 10 of the body slot 9 is 9/16 of an inch, the slot throat 11 is 11/16 of an inch and the diameter of the sucker rod bore 8 is 15/16 of an inch. Similarly, for a sucker rod 13*a* having a diameter of 7/8 of an inch, the slot mouth 10 is 7/16 of an inch, the slot throat 11 is 9/16 of an inch and the diameter of the sucker rod bore 8 is 13/16 of an inch. Under circumstances where the sucker rod 13*a* is ¾ of an inch in outside diameter, the slot mouth 10 is 5/16 of an inch, the slot throat 11 is 7/16 of an inch and the diameter of the sucker rod bore 8 is 11/16 of an inch. Furthermore, for a sucker rod 13*a* which is ⅝ of an inch in outside diameter, the slot mouth 10 of the body slot 9 is 3/16 of an inch, the slot throat 11 is 5/16 of an inch and the diameter of the sucker rod bore 8 is 9/16 of an inch.

It will be further appreciated by those skilled in the art that the sucker rod guide of this invention is characterized by a high degree of utility, reliability and longevity, in that in a most preferred embodiment it is constructed of a high density polyethylene material which has good self-lubricating and/or wet-lubricating characteristics, high abrasion resistance and toughness and the necessary resiliency to facilitate mounting on a sucker rod without shattering, deforming or moving excessively on the sucker rod. Furthermore, the sucker rod guide can be constructed to any specifications for fitting on a sucker rod of any outside diameter and is quickly and easily installed on the sucker rod using conventional tools and equipment.

While the preferred embodiments of the invention have been described above, it will be recognized and understood that various modifications may be made therein and the appended claims are intended to cover all such modifications which may fall within the spirit and scope of the invention. For example, referring again to the drawing, while high density, extruded polyethylene plastic is the material of first choice in fabricating the sucker rod guide 1 of this invention, the polyethylene plastic can also be injection-molded to create the sucker rod guide 1. Moreover, it will be recognized that other plastic materials known to those skilled in the art, whether extruded or injection-molded, which have the requisite lubricating, resiliency and toughness characteristics can be fabricated with an undersized, sucker rod bore 8 and a tapered body slot 9, to create the desired "spring" tension when mounted on a sucker rod 13*a*, according to the teachings of this invention.

Having described my invention with the particularity set forth above, what is claimed is:

1. A sucker rod guide for mounting on a sucker rod and spacing the sucker rod from the tubing in an oil well, comprising a generally cylindrically-shaped, extruded, ultra-high density polyethylene body having a substantially smooth outside surface; a longitudinal bore provided centrally of said body, said bore having a smaller diameter than the diameter of the sucker rod; a plurality of grooves provided in circumferential relationship in said bore; and a tapered slot extending longitudinally through said body from said outside surface to said bore, said tapered slot further comprising a slot mouth located at said outside surface and a slot throat spaced from said slot mouth, said slot throat lying adjacent to said sucker rod bore and wherein said slot throat is wider than said slot mouth for mounting said sucker rod guide on the sucker rod.

2. The sucker rod guide of claim 1 further comprising a first taper terminating one end of said body and a second taper terminating the opposite end of said body.

3. A sucker rod guide for mounting on a sucker rod and spacing the sucker rod from the tubing in an oil well, comprising a generally cylindrically-shaped, extruded polyethylene body having an ultra-high density and a substantially smooth outside surface; a longitudinal bore extending centrally through the length of said body, said bore having a smaller diameter than the diameter of the sucker rod; a plurality of grooves provided in circumferential relationship in said bore; and a tapered slot extending longitudinally through said body from a first width at said outside surface to a second width at said bore, said first width normally being more narrow than said second width when said sucker rod guide is not mounted on the sucker rod, for mounting said sucker rod guide on the sucker rod.

4. The sucker rod guide of claim 3 further comprising a first taper terminating one end of said body and a second taper terminating the opposite end of said body.

* * * * *